US011465654B2

(12) United States Patent
Huck et al.

(10) Patent No.: US 11,465,654 B2
(45) Date of Patent: Oct. 11, 2022

(54) HOURGLASS AUTORACK CAR ROOF

(71) Applicant: Trinity Rail Group, LLC, Dallas, TX (US)

(72) Inventors: Kenneth W. Huck, Fairview, TX (US); Brant R. McGhee, Arlington, TX (US); Kyle R. Coston, Forney, TX (US); Steven E. Daniels, Hewitt, TX (US); Robert C. Runyan, Elm Mott, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 211 days.

(21) Appl. No.: 16/806,277

(22) Filed: Mar. 2, 2020

(65) Prior Publication Data

US 2021/0269066 A1 Sep. 2, 2021

(51) Int. Cl.
*B61D 3/02* (2006.01)
*B61D 3/18* (2006.01)

(52) U.S. Cl.
CPC ..... *B61D 3/187* (2013.01); *B61D 3/02* (2013.01); *B61D 3/181* (2013.01)

(58) Field of Classification Search
CPC ..... B61D 3/187; B61D 3/181; B61D 17/12; B61D 3/18; B61D 17/08; B61D 3/02; B61D 1/06; B61D 3/185
See application file for complete search history.

(56) References Cited

U.S. PATENT DOCUMENTS

| | | | | | |
|---|---|---|---|---|---|
| 432,954 | A * | 7/1890 | Sessions | B61D 1/06 | 105/340 |
| 1,292,899 | A * | 1/1919 | Slick | B61D 17/08 | 105/406.1 |
| 3,474,740 | A * | 10/1969 | Varnes | B61D 5/06 | 105/360 |
| 3,584,584 | A * | 6/1971 | Milenkovic | B61D 1/04 | 410/1 |
| 5,579,697 | A * | 12/1996 | Burke | B61D 3/18 | 105/355 |
| 6,213,028 | B1 * | 4/2001 | Fetterman | B61D 7/02 | 105/238.1 |
| 2017/0334462 | A1 * | 11/2017 | Richmond | B61D 3/18 | |

* cited by examiner

*Primary Examiner* — Mark T Le
(74) *Attorney, Agent, or Firm* — Baker Botts, LLP

(57) ABSTRACT

According to some embodiments, an autorack railcar roof assembly comprises a center roof panel, a first intermediate roof panel adjacent one side of the center roof panel, and a second intermediate roof panel adjacent an opposite of the center roof panel from the first intermediate roof panel. The center roof panel comprises a first width. The first and second intermediate roof panels each comprise a second width greater than the first width.

20 Claims, 15 Drawing Sheets

HOURGLASS AUTORACK CAR ROOF

TECHNICAL FIELD OF THE INVENTION

This disclosure generally relates to railcars, and more particularly to an hourglass shaped autorack railcar roof.

BACKGROUND

An autorack railcar (also referred to as an auto carrier or car transporter) is a railcar for transporting automobiles and light trucks. For example, an autorack railcar may transport vehicles from a manufacturing facility to a distributorship, or transport vehicles for passengers of a passenger train service.

An autorack railcar generally includes two or three decks for transporting vehicles. Some autorack railcars are convertible between two and three decks. The cars are typically fully enclosed with continuous side panels, end doors, and roofs to protect the vehicles from severe weather, theft/vandalism, or other in-transit damage.

To load an autorack railcar, a skilled driver drives the vehicle up a ramp and onto one of the decks. The driver or another crew member then secures the vehicle to the deck with tie down straps, chains, etc. The process is reversed to unload the autorack railcar.

Conventional autorack railcars typically have limited interior width for personnel to maneuver between the side panels of the railcar and vehicles loaded in the railcar. This problem is more noticeable with wide vehicles, such as pickup trucks with sets of dual rear wheels, or vehicles without folding mirrors.

A conventional autorack railcar may be a constant width (e.g., 9'11") for the length of the railcar. Railcar width is constrained by American Association of Railroads (AAR) regulations in Standard S-2030 Plate D, S-2047 Plate J, and S-2048 Plate K. Plates J and K describe the overall equipment diagram for railcars up to 19'0" and 20'3" tall, respectively.

SUMMARY OF THE INVENTION

The constant width of a conventional autorack railcar provides limited interior width for personnel to maneuver between the side panels of the railcar and the vehicles loaded in the railcar. The embodiments described herein include a variable width, hourglass-shaped autorack railcar.

According to some embodiments, an autorack railcar comprises a first end, a second end, first and second longitudinal sides disposed between the first end and the second end, and a roof assembly disposed longitudinally between the first end and the second end and transversely between the first longitudinal side and the second longitudinal side. The railcar further comprises a rack for transporting vehicles generally enclosed by the first end, the second end, the first longitudinal aide, the second longitudinal side, and the roof assembly.

A first width of the roof assembly between the first longitudinal side and the second longitudinal side proximate a center of the autorack railcar comprises a first width value, and a second width of the roof assembly between the first longitudinal side and the second longitudinal side between the center of the autorack railcar and either the first end or the second end comprises a second width value. The second width value is greater than the first width value.

In particular embodiments, the first width value is approximately 9 feet 11 inches and the second width value is between 9 feet 11 inches and approximately 10 feet 8 inches. In particular embodiments, a third width of the roof assembly between the first longitudinal side and the second longitudinal side proximate either the first end or the second end comprises a third width value. The third width value is greater than the first width value and greater than the second width value.

In particular embodiments, the first longitudinal side comprises a center panel and an intermediate panel. The center panel is disposed between a center of the railcar and the intermediate panel. The intermediate panel is disposed between the center panel and the first end or the second end. A width of the railcar at the intermediate panel is greater than a width of the railcar at the center panel. The roof assembly comprises a center roof panel and an intermediate roof panel. The center roof panel is disposed between the center panel of the first longitudinal side and the second longitudinal side, and the intermediate roof panel is disposed between the intermediate panel of the first longitudinal side and the second longitudinal side. A width of the roof assembly at the intermediate roof panel is greater than a width of the roof assembly at the center roof panel.

In particular embodiments, a width of the center roof panel is constant along the longitudinal length of the center roof panel. The width of the intermediate roof panel may increase in width as the intermediate roof panel extends from an edge adjacent to the center roof panel towards the first or second end.

In particular embodiments, the first longitudinal side further comprises an end panel disposed between the intermediate panel and the first end or the second end, and the roof assembly further comprises an end roof panel. The end roof panel is disposed between the end panel of the first longitudinal side and the second longitudinal side. A width of the end roof panel may be constant along the longitudinal length of the end roof panel.

In particular embodiments, a width of the intermediate roof panel varies from approximately 9 feet 11 inches proximate the center roof panel to between 9 feet 11 inches and 10 feet 8 inches at the opposite end of the intermediate roof panel.

According to some embodiments, an autorack railcar roof assembly comprises a center roof panel, a first intermediate roof panel adjacent one side of the center roof panel, and a second intermediate roof panel adjacent an opposite side of the center roof panel from the first intermediate roof panel. The center roof panel comprises a first width and the first and second intermediate roof panels each comprise a second width greater than the first width.

In particular embodiments, the first width value is approximately 9 feet 11 inches. The second width value may be between 9 feet 11 inches and approximately 10 feet 8 inches.

In particular embodiments, the width of the center roof panel is constant along the longitudinal length of the center roof panel. The width of the first and second intermediate roof panels may increase in width as the intermediate roof panel extends from an edge adjacent to the center roof panel towards an opposite edge. A width of the first and second intermediate roof panel may vary from approximately 9 feet 11 inches proximate the center roof panel to between 9 feet 11 inches and 10 feet 8 inches at an opposite edge.

In particular embodiments, the autorack railcar roof assembly further comprises a first end roof panel adjacent the first intermediate panel and a second end roof panel adjacent the second intermediate panel. The first and second end roof panels each comprise a third width greater than the second width. A width of the first and second end roof panels may be constant along the longitudinal length of the first and second end roof panels.

According to some embodiments, a method for coupling a fixed-width autorack railcar roof assembly to a variable width autorack railcar comprises: providing a fixed-width autorack railcar roof assembly; providing a roof rail wherein a top portion of the roof rail conforms to the edge of the fixed-width autorack railcar roof assembly and a bottom portion of the roof rail conforms to a contour of the sidewall of a variable-width autorack railcar; coupling the bottom portion of the roof rail to the variable-with autorack railcar; and coupling the top portion of the roof rail to the fixed-width autorack railcar roof assembly.

As a result, particular embodiments of the present disclosure may provide numerous technical advantages. For example, the additional autorack railcar width provides additional room within the railcar, which improves crew ergonomics by providing more room to conduct normal operations and reduces the likelihood of vehicle damage caused by close working conditions. Some embodiments facilitate use of historical fixed-width autorack roof panels and provide convertibility of a legacy fleet to the hour glass shape and a recertification processes with minimal to no modifications made to the roof profiles. The backwards compatibility provides inventory flexibility. Particular embodiments of the present disclosure may provide some, none, all, or additional technical advantages.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Conventional fixed-width autorack railcars provide limited interior space for personnel to maneuver between the side panels of the railcar and the vehicles loaded in the railcar. Particular embodiments obviate the problems described above and include a variable width, hourglass-shaped autorack railcar.

AAR Plate K permits modification of maximum railcar width under particular conditions, such as truck center distance, car height, etc. The maximum width at any longitudinal location along a railcar may be determined by a formula. Particular embodiments include a variable width railcar that complies with regulations while also providing additional width and interior clearance (e.g., up to 4.5" per side) for much of the length of the railcar. The additional interior clearance improves crew ergonomics by providing more room to conduct normal operations and reduces the likelihood of vehicle damage caused by close working conditions.

As an example, AAR Plate J restricts railcar width to a 10'8" maximum at any location for a railcar with truck centers spaced at 55'1" apart. The maximum width at the center of a railcar with a common truck spacing of, for example, 66' is approximately 9'11". Moving longitudinally outward from the center of the railcar, the maximum width increases to 10'8". Using a 90' railcar as an example, the permissible width approximately 18' from the center of the car outward to approximately 43' is 10'8". From 43' outward to the end of the railcar (i.e., 45'), the permissible width is approximately 10'3.8".

Particular embodiments take advantage of the variable width requirements to expand the width of an autorack railcar at particular locations beneficial for the crew that loads or unloads the autorack railcar. For example, although the maximum width at the center of an autorack railcar with a common truck spacing of 66' is approximately 9'11", the width of the autorack railcar may be wider in other locations. Particular embodiments include an hourglass-shaped autorack railcar where the autorack railcar is narrow at a center point and gets wider towards each end of the car. Particular embodiments provide extra width at the locations where an operator entering or exiting a vehicle during the loading/unloading process may benefit from extra maneuverability.

Plate K specifies requirements for taller railcars. Particular embodiments may include hourglass-shaped autorack railcars for any suitable configuration or combination of truck center distances, railcar lengths, railcar heights, or other suitable parameters.

Particular embodiments and their advantages are best understood by reference to FIGS. 1-15 wherein like reference numbers indicate like features.

Figure 1:
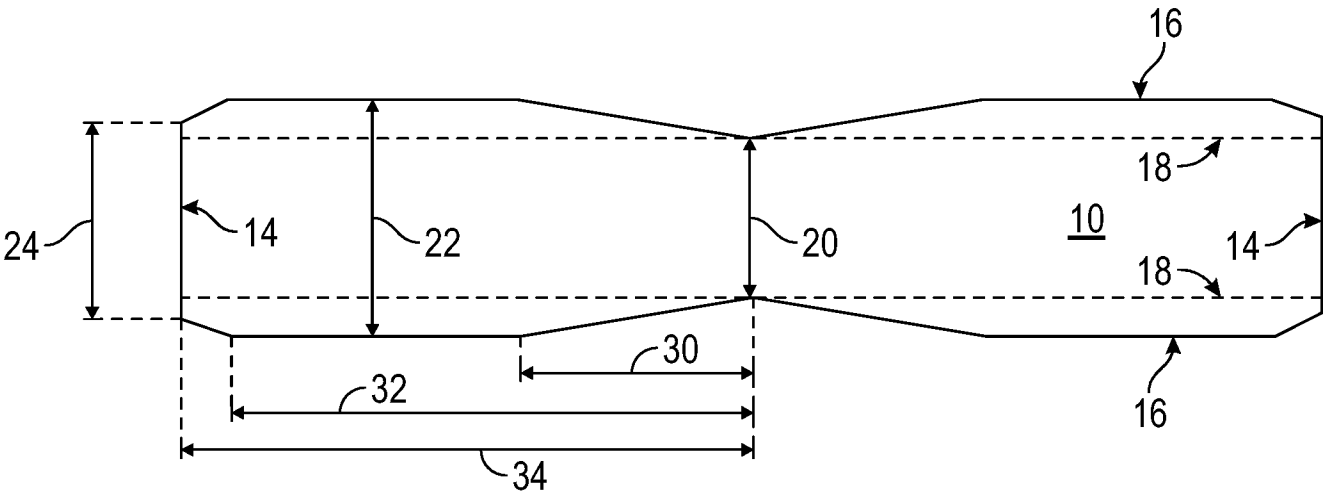
FIG. 1 is a schematic diagram overhead view of an autorack railcar, according to some embodiments.

FIG. 1 is a schematic diagram overhead view of an autorack railcar, according to some embodiments. Autorack railcar 10 includes ends 14 and longitudinal sides 16. Longitudinal sides 16 and ends 14 enclose a rack for transporting vehicles and generally protect the vehicles from the elements during transport.

Autorack railcar 10 includes variable widths along the longitudinal length (i.e., variable width between longitudinal sides 16) of the railcar. Dashed lines 18 represent the fixed width of a conventional autorack railcar.

In particular embodiments, the width of autorack railcar 10 approximates an hourglass shape with a minimum width 20 at the center of autorack railcar 10 and a width that expands over the distance 30 to a maximum width 22. The maximum width 22 continues out to distance 32 and then reduces to end width 24 at distance 34. As illustrated, particular embodiments provide additional width than a conventional autorack railcar (represented by dashed lines 18) at particular locations along the length of railcar 10. The additional width may provide additional room for crew members to operate and may reduce the chances of vehicle damage.

As a particular example, autorack railcar 10 may comprise a 90' railcar with trucks spaced at 66'. In this example, minimum width 20 is approximately 9'11". The width of autorack railcar 10 may gradually increase over distance 30 (e.g., approximately 18' from center) to maximum width 22. In this example, maximum width 22 is approximately 10'8". The width of autorack railcar 10 may be a constant 10'8" between distance 30 (e.g., approximately 18' from center) and distance 32 (e.g., approximately 43' from center). At the end of autorack railcar 10, its width may gradually reduce between distance 32 (e.g., approximately 43' from center) and 34 (e.g., approximately 45' from center) to end width 24.

In this example, end width 24 is approximately 10'3.8".

Accordingly, some portions of the example autorack railcar 10 (e.g., the portion having width 22) may be up to approximately 9" wider than a conventional fixed width autorack railcar (i.e., 10'8"-9'11"=9"). The additional 9" may provide extra clearance (e.g., up to 4.5") on each side of a vehicle loaded in autorack railcar 10, which provides additional room for a crew to perform interior operations in autorack railcar 10. Other embodiments may include any suitable dimensions.

Figure 2:
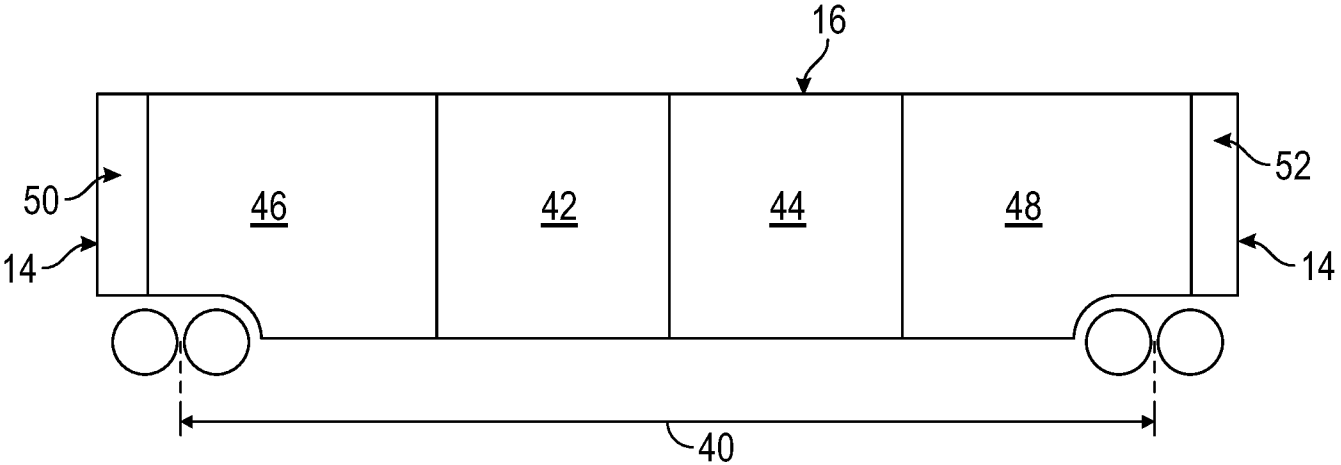
FIG. 2 is a schematic diagram side view of an autorack railcar, according to some embodiments.

FIG. 2 is a schematic diagram side view of an autorack railcar, according to some embodiments. FIG. 2 illustrates a side view, for example, of autorack railcar 10 described with respect to FIG. 1. Autorack railcar 10 includes truck center distance 40. The side panels of autorack railcar 10 include left center panel 42, right center panel 44, left intermediate panel 46, right intermediate panel 48, left end panel 50, and right end panel 52.

Left center panel 42 and right center panel 44 are positioned on each side of the center line of autorack railcar 10. Railcar 10 has a minimum width at the center of left center panel 42 and right center panel 44. Moving outward longitudinally from the center of autorack railcar 10, autorack railcar 10 has a maximum width along the length of left intermediate side panel 46 and right intermediate side panel 48. The width of autorack railcar 10 reduces again along left end panel 50 and right end panel 52. Although the various panels 42, 44, 46, 48, 50 and 52 are described as a single panel, in particular embodiments each panel may comprise any number of panels or sub-panels.

As a particular example, autorack railcar 10 may comprise a 90' railcar and truck center distance 40 may be approximately 66'. The width of autorack railcar 10 at left center panel 42 may be approximately 9'11" at the center of the railcar. Left center panel 42 may be approximately 18' in length and the width of autorack railcar 10 may be approximately 10'8" at the leftmost side of center panel 42. Right center panel 44 may be approximately 18' in length and the width of autorack railcar 10 may be approximately 10'8" at the rightmost side of right center panel 44.

The width of autorack railcar 10 for the length of left intermediate side panel 46 and right intermediate side panel 48 may be approximately 10'8". Left intermediate side panel 46 and right intermediate side panel 48 may be approximately 25' in length.

Left end panel 50 and right end panel 52 may be approximately 2' in length. The width of autorack railcar 10 is approximately 10'8" at the rightmost side of left end panel 50 and approximately 10'3.8" at the leftmost side of left end panel 50. The width of autorack railcar 10 is approximately 10'8" at the leftmost side of right end panel 52 and approximately 10'3.8" at the rightmost side of right end panel 52.

In particular embodiments, the width of autorack railcar 10 is generally constant over a vertical dimension of autorack railcar 10. For example, the width of autorack railcar 10 at any particular location along longitudinal sides 16 is the same width from the bottom of longitudinal side 16 (e.g., near the railcar floor) to the top of longitudinal side 16 (e.g., near the railcar roof). As a particular example, the width of autorack railcar 10 at left intermediate side panel 46 may be 10'8". The width of autorack railcar 10 at left intermediate side panel 46 is generally a constant 10'8" across the vertical dimension of left intermediate side panel 46 (e.g., generally constant from floor to roof).

Other embodiments may include any suitable dimensions or any suitable number of side panels. For example, particular embodiments may not include left end panel 50 or right end panel 52. In such embodiments, left intermediate side panel 46 and/or right intermediate side panel 48 may extend to the end of autorack railcar 10, and the width of autorack railcar 10 may be constant (e.g., approximately 10'3.8" in some embodiments) along the length of left intermediate side panel 46 and/or right intermediate side panel 48.

The example autorack railcar illustrated in FIGS. 1 and 2 includes generally straight side panels that may be connected at various angles to transition between the various widths at the various locations along the length of the railcar. For example, left end panel 50, left intermediate side panel 46, and left center panel 42 may all comprise panels that are straight along their horizontal dimension. Left end panel 50 is coupled to left intermediate side panel 46 at a first angle, and left intermediate side panel 46 is coupled to left center panel 42 at a second angle to vary the width along the longitudinal direction of autorack railcar 10. In particular embodiments, generally straight side panels may be relatively easy and inexpensive to manufacture compared to other configurations. Other embodiments may include other types of side panels, such as curved side panels, or a combination of straight and curved side panels.

Figure 3:
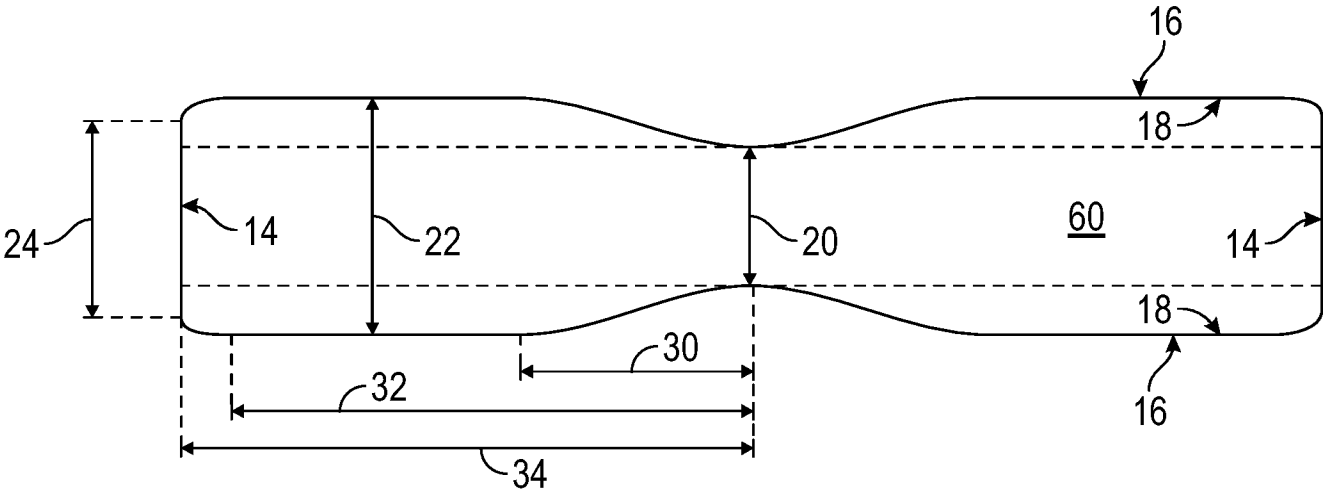
FIG. 3 is a schematic diagram overhead view of another autorack railcar, according to some embodiments.

FIG. 3 is a schematic diagram overhead view of another autorack railcar, according to some embodiments. Autorack railcar 60 is similar to autorack railcar 10 illustrated in FIG. 1, except autorack railcar 60 includes curved side panels.

For example, each longitudinal side 16 may include curved side panels that curve between the centerline and distance 30 on either side of the center line. In particular embodiments, the curved side panel may comprise a single curved side panel or a combination of several curved sub-panels. In particular embodiments, the curved side panels may be curved for the vertical length of the panel (e.g., the side panel may be curved from floor to roof).

As another example, each longitudinal side 16 may include curved side panels near each end 14 of autorack railcar 60, such as between distances 32 and 34. Although each curve is illustrated with a particular radius, other embodiments may include any suitable radius to maximize the interior space of an autorack railcar without exceeding width regulations at any particular point along the length of the railcar.

Figure 4:
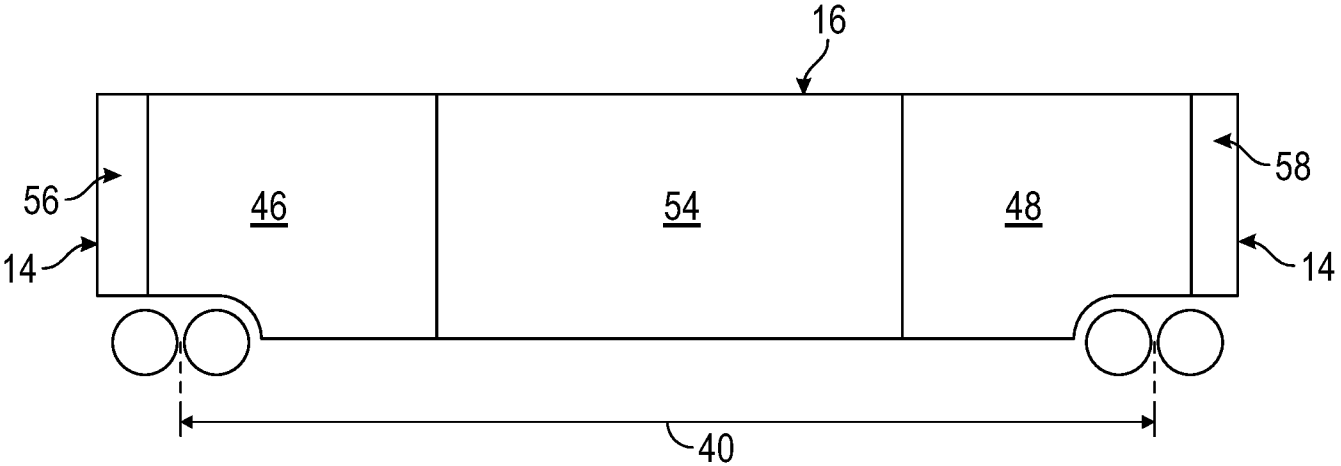
FIG. 4 is a schematic diagram side view of another autorack railcar, according to some embodiments.

FIG. 4 is a schematic diagram side view of another autorack railcar, according to some embodiments. FIG. 4 illustrates a side view, for example, of autorack railcar 60 described with respect to FIG. 3. Longitudinal side 16 of the autorack railcar includes curved side panels 54, 56, and 58.

In particular embodiments, the racks for transporting vehicles within an autorack railcar may be positioned or configured with the respect to the autorack railcar width dimensions to optimize crew access to the vehicles for transport. For example, the rack may be configured such that the hood or trunk portion of the vehicle is located in the narrower width portion of the autorack railcar, and vehicle openings, such as the driver side window and door, are located in the wider portion of the autorack railcar.

Figure 5:
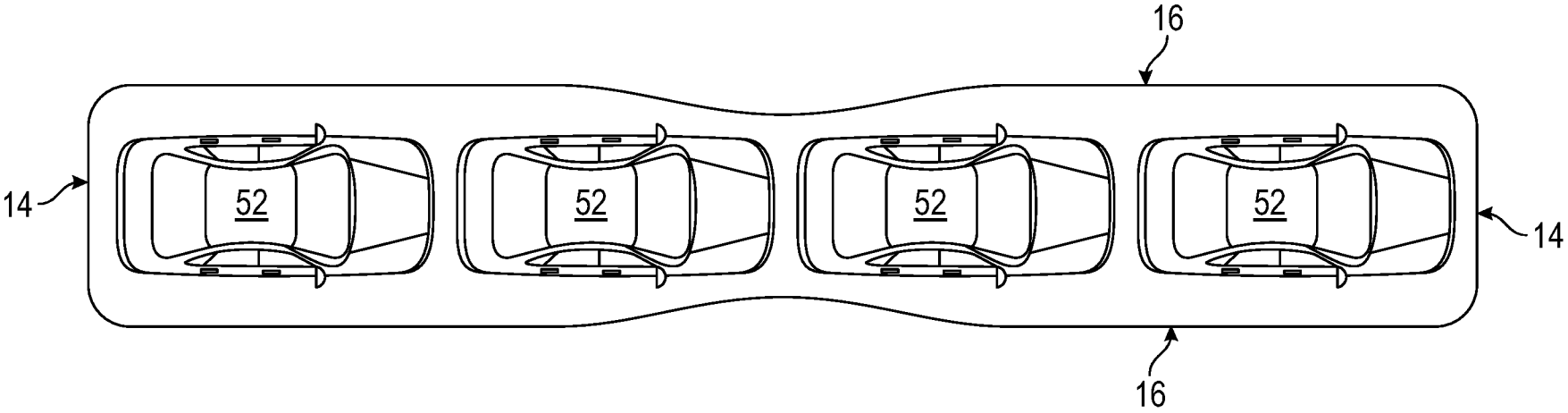
FIG. 5 is a schematic diagram overhead view of an example autorack loaded with vehicles, according to a particular embodiment.

FIG. 5 is a schematic diagram overhead view of an example autorack loaded with vehicles, according to a particular embodiment. The example autorack railcar, such as autorack railcar 10 described with respect to FIGS. 1 and 2 or autorack railcar 60 described with respect to FIGS. 3 and 4, includes vehicles 52. Although 4 vehicles are illustrated, particular embodiments may include any suitable number of vehicles on one or more decks.

As illustrated, the varying width of longitudinal sides 16 provides extra room for maneuvering around vehicles 52. The extra room is particularly advantageous when vehicles 52 comprise wide vehicles, such as pickup trucks with sets of dual rear wheels, or when vehicles 52 comprise vehicles without folding mirrors.

As described above, an hour glass-shaped autorack provides additional interior width to provide more side clearance to vehicles loaded into the rack and facilitates loading of wider vehicles. Particular embodiments also include changes to a traditional roof assembly to connect the roof with the hour glass-shaped rack structure.

A roof assembly consists of roof panels and roof rails that attach the roof panels to the rack structure. The hour glass-shaped rack structure changes width along its length, but standard existing roof panels are of a constant width.

Autoracks today use a standard corrugated roof panel. The corrugations provide the necessary structural properties to the roof to withstand the autorack forces applied to it, including snow and ice loads, rack deflections and side loads, etc. The standard roof panel was designed for a constant width autorack and is not compatible with an hour glass-shaped section below it that it needs to attach to.

Although the hour glass autorack design increases the width between the side walls of the rack, the roof area is also important because it extends downward below the roof line of the vehicles under transport. Clearance to the roof becomes particularly important because a driver needs to open the door of the vehicle to exit and enter the vehicle inside the rack. As the vehicle door is opened, the top corner of the door may be the closest point to making contact with the interior of the rack in the roof area. Contact could cause vehicle damage and should be avoided. An example is illustrated in FIG. 6.

Figure 6:
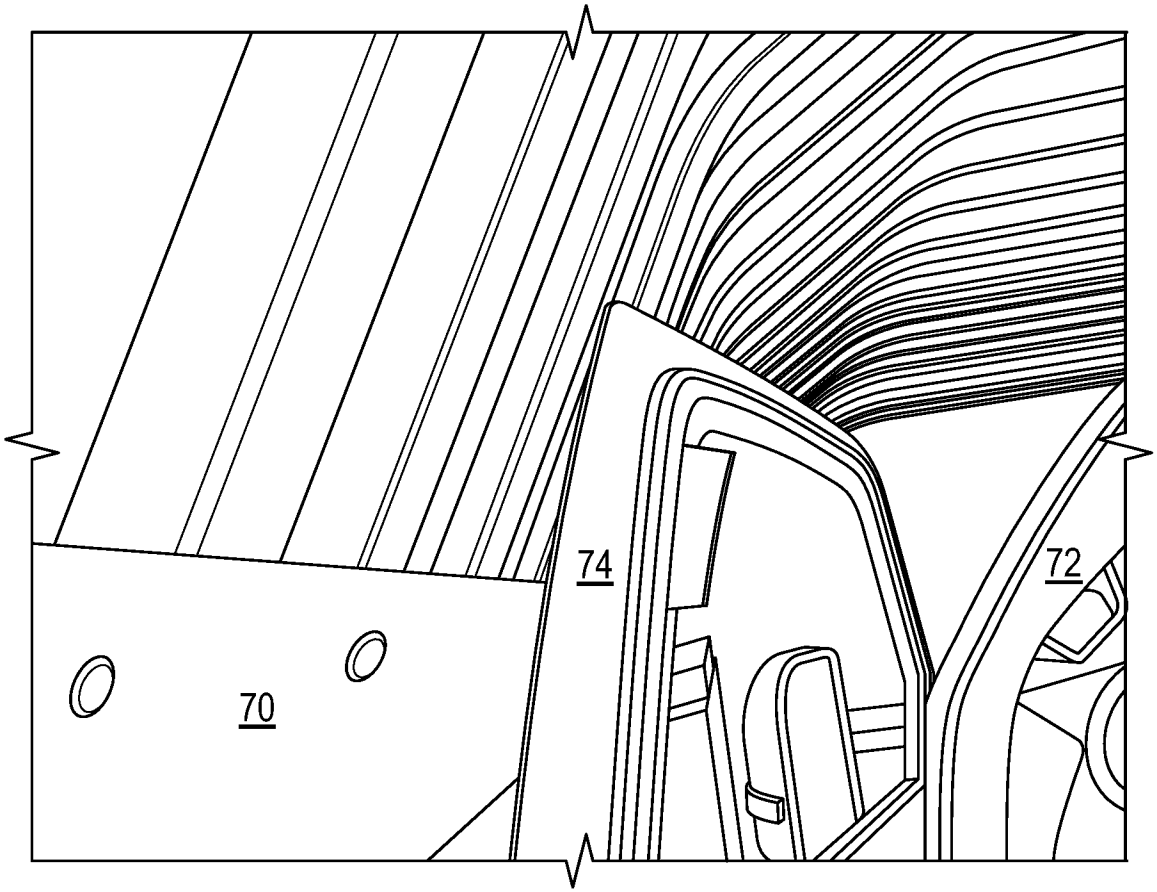
FIG. 6 is a perspective view of a vehicle within an autorack car.

FIG. 6 is a perspective view of a vehicle within an autorack car. As illustrated, autorack roof assembly 70 arches around portions of vehicle 72. Vehicle door 74 is in an open position, and the top of vehicle door 74 is nearly contacting autorack roof assembly 70.

A first group of embodiments include a roof assembly with hour glass-shaped roof panels expanded and reshaped to meet the extents of the AAR clearance plate (i.e., the roof panels conform to the same hour glass-shape as the underlying railcar). The first group of embodiments is illustrated in FIGS. 7A-8C.

A second group of embodiments use an industry standardized roof profile and a redesigned rail that attaches the roof to the hour glass-shaped autorack superstructure. The second group of embodiments is illustrated in FIGS. 9-14.

In the first group of embodiments, one benefit is a roof profile that extends to the limits of the AAR plate clearance that provides more interior space in the proximate area between sidewall posts numbers 1 and 5 and between sidewall posts number 8 and 12 in the vertical area of the roof. Examples are illustrated in FIGS. 6 and 7A.

Because the hour glass-shaped rack may not change width near center of the railcar, existing standard roof panels may be used near the center of the railcar. Where the hour glass-shaped rack achieves its maximum width, existing wider roof panels may be used there. One or more tapered roof panels may be used to transition between the panels near the center of the rack and the wider panels toward the end of the rack. An example is illustrated in FIGS. 7A and 7B.

In particular embodiments, the ends of the tapered sections are configured to interface with the existing roof panels to provide a leak-free connection. In some embodiments, the roof rail that mounts the roof panels to the rack structure may not have to change geometry other than for the required length.

Figure 7A:
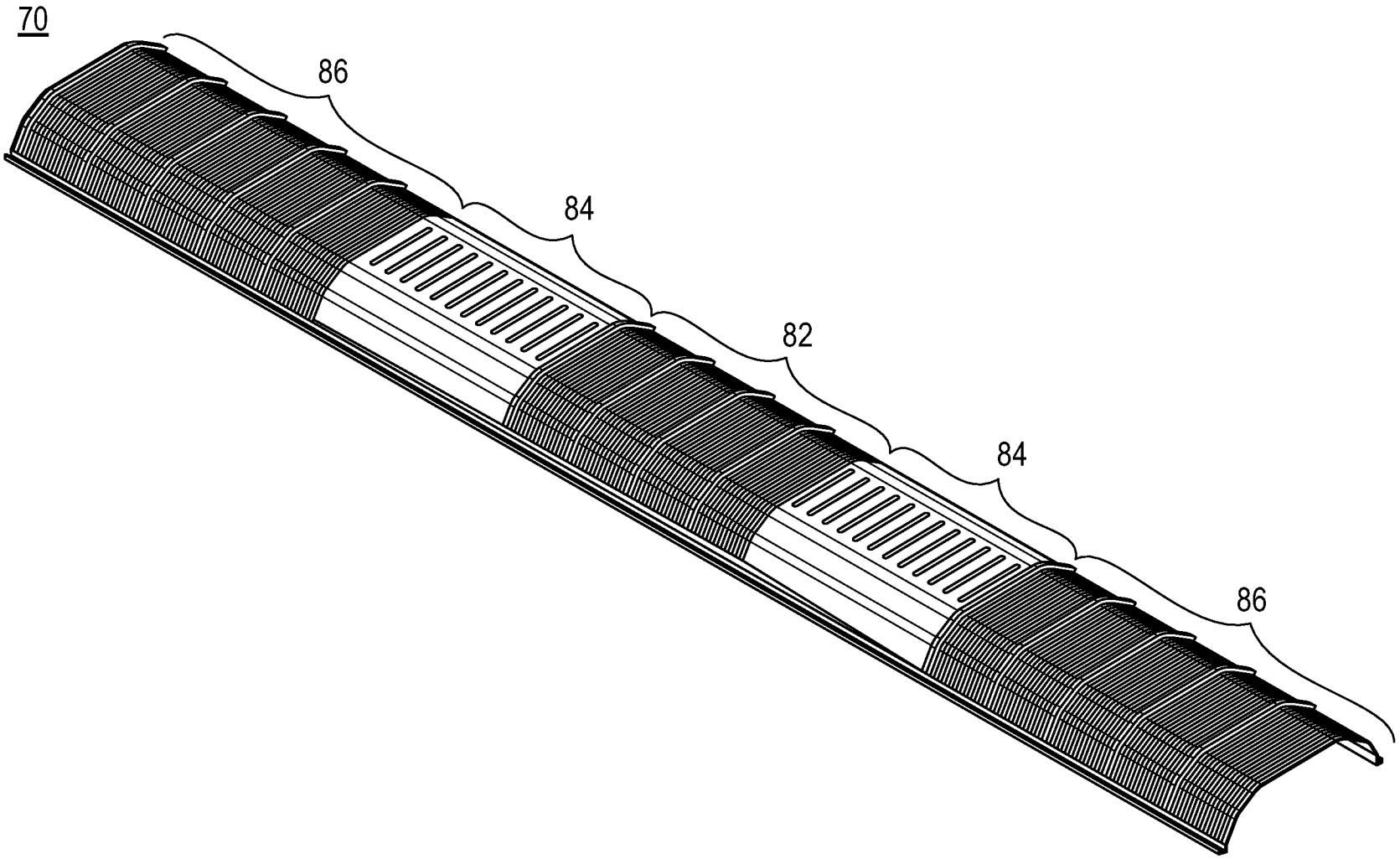
FIG. 7A is a perspective view of an hour glass-shaped autorack railcar roof assembly, according to a particular embodiment.
Figure 7B:
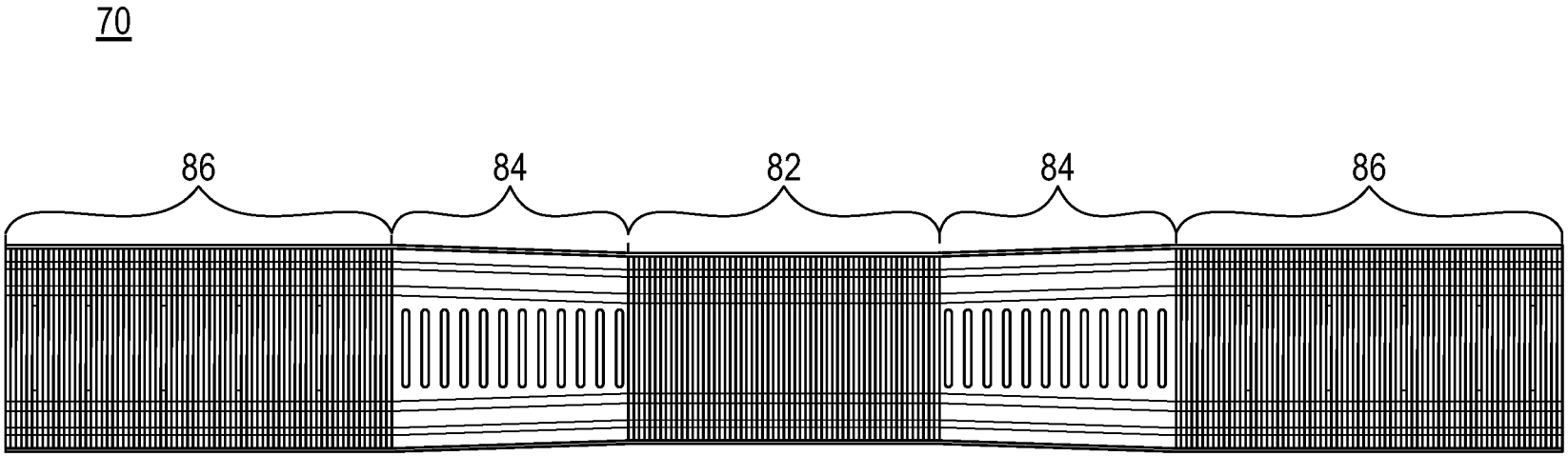
FIG. 7B is an overhead plan view of an hour glass-shaped autorack railcar roof assembly, according to a particular embodiment.

FIG. 7A is a perspective view of an hour glass-shaped autorack railcar roof assembly, according to a particular embodiment. Autorack railcar roof assembly 70 includes center roof panel 82, intermediate roof panels 84 and end roof panels 86.

In the illustrated example, center roof panel 82 is a constant width. Intermediate roof panels 84 increase in width as the intermediate roof panel extends from an edge adjacent to the center roof panel 82 towards an opposite edge. End panels 86 are a constant width. The widths of center roof panel 82, intermediate roof panels 84 and end roof panels 86 correspond to the widths of the side walls of an underlying autorack railcar.

To fit within the AAR window, center roof panel 82 may be width value is approximately 9 feet 11 inches. Intermediate roof panel 84 may vary from approximately 9 feet 11 inches proximate center roof panel 82 to between 9 feet 11 inches and 10 feet 8 inches at the opposite end of intermediate roof panel 84.

FIG. 7B is an overhead plan view of an hour glass-shaped autorack railcar roof assembly, according to a particular embodiment. Autorack railcar roof assembly 70 is the same as autorack railcar roof assembly 70 in FIG. 7A. The overhead view illustrates the taper of intermediate roof panel 84.

Figure 8A:
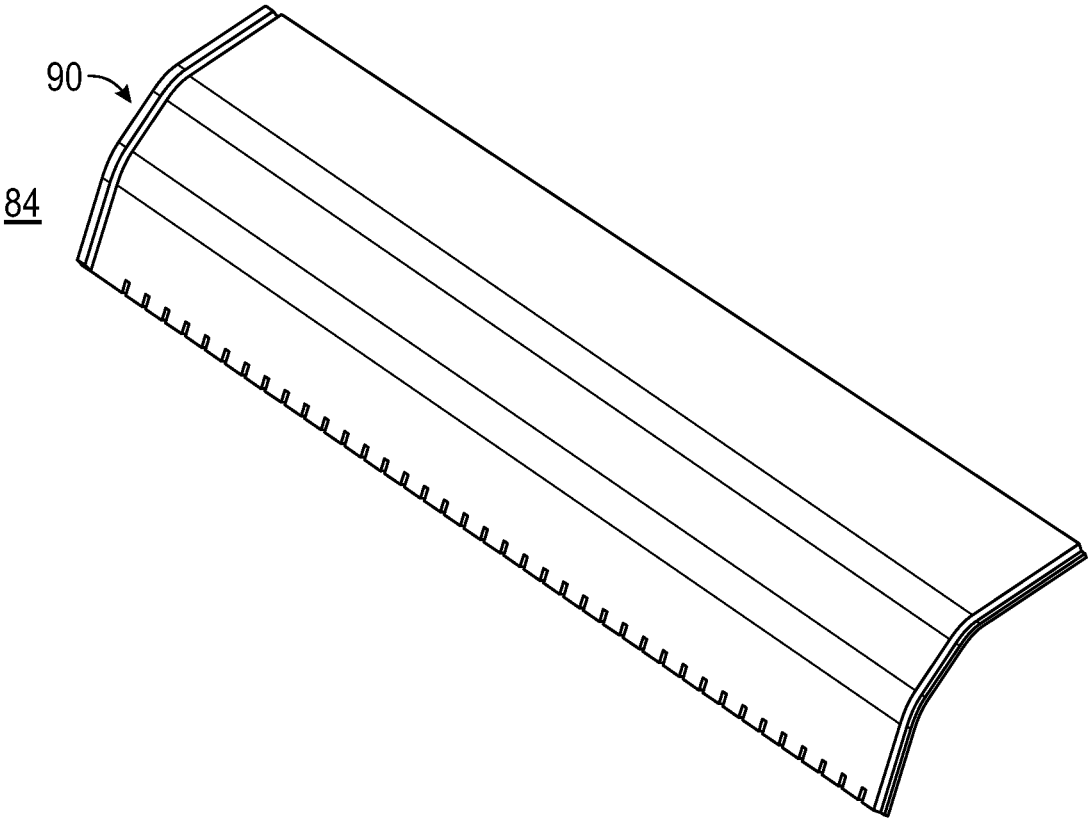
FIG. 8A is a perspective view of one half of a variable-width roof panel, according to a particular embodiment.

FIG. 8A is a perspective view of one half of a variable-width roof panel, according to a particular embodiment. The illustrated example is one half of intermediate roof panel 84 illustrated in FIGS. 7A and 7B.

Intermediate roof panel 84 includes roof panel interfaces 90 for interfacing with the center roof panel 82 and end roof panel 86.

Figure 8B:
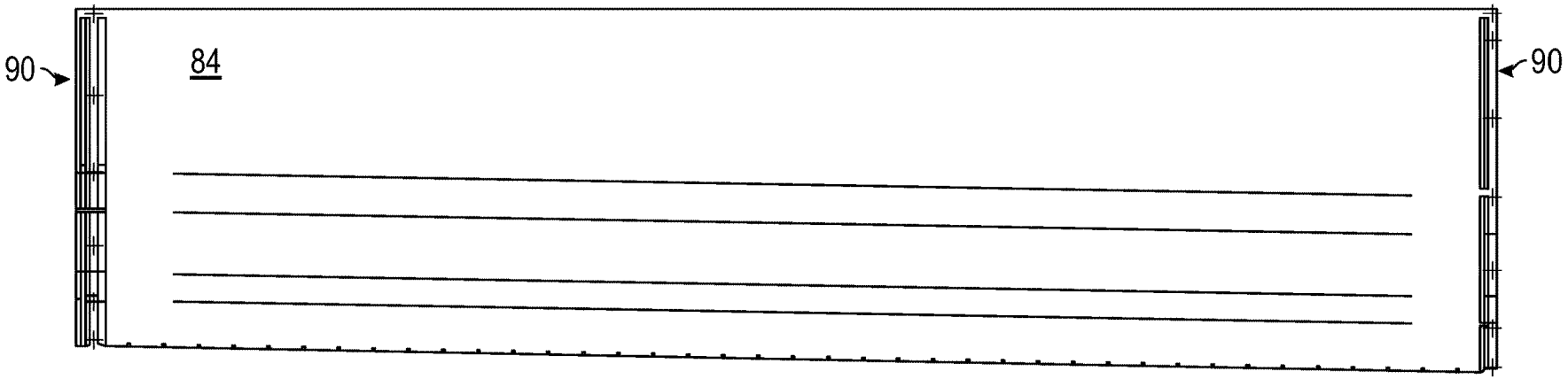
FIG. 8B is an overhead plan view of a variable-width roof panel, according to a particular embodiment.

FIG. 8B is an overhead plan view of a variable-width roof panel, according to a particular embodiment. Intermediate roof panel 84 is the same as intermediate roof panel 84 in FIG. 8A. The overhead view illustrates the taper of intermediate roof panel 84.

Figure 8C:
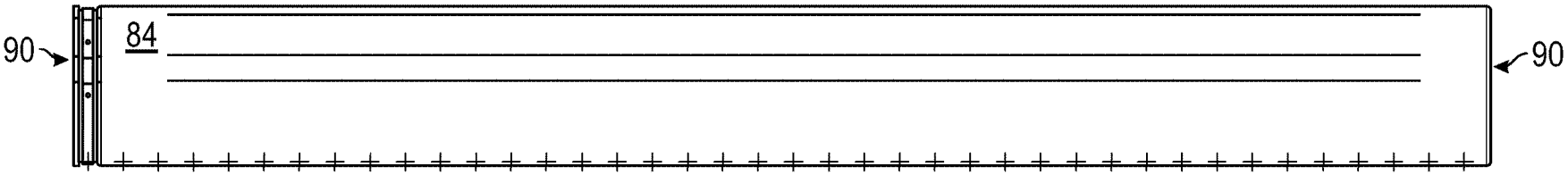
FIG. 8C is a side view of a variable-width roof panel, according to a particular embodiment.

FIG. 8C is a side view of a variable-width roof panel, according to a particular embodiment. Intermediate roof panel 84 is the same as intermediate roof panel 84 in FIG. 8A.

In some embodiments, the roof assembly may comprise various combinations of new and existing roof panels, tapered sections, roof rail changes, etc. to achieve increased interior clearance. Tapered sections may be of different lengths to achieve increased interior clearance. Existing or newly created roof panels may be used to create increased interior width in some areas of the autorack railcar. Existing or new roof panels may be attached in various ways to move their mounting points outward in certain areas to achieve increased interior width without violating exterior AAR standard plate clearances.

The second group of embodiments use industry standardized roof panels with a redesigned roof rail to attach to the transversely extended outer posts of the hour glass-shaped autorack. Particular embodiments use a transitional rail (one piece or multiple pieces) between side wall posts numbers 6 to 4 and side wall posts numbers 7 to 9 that enable the standardized roof panels to be attached to the posts with minimal to no modifications made to the standardized roof profiles. Examples are illustrated in FIGS. 9-14.

Figure 9:
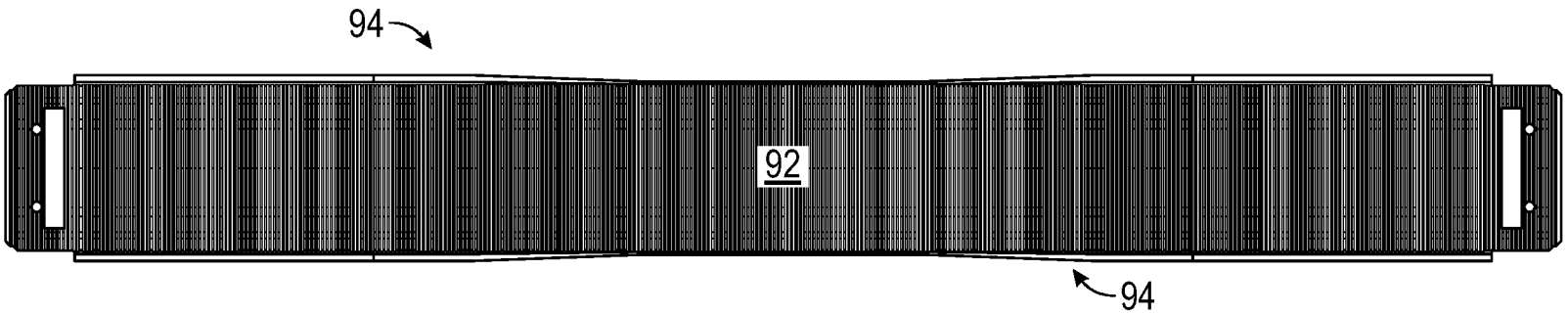
FIG. 9 is an overhead plan view of a fixed-width autorack railcar roof assembly on a variable-width autorack railcar, according to a particular embodiment.

FIG. 9 is an overhead plan view of a fixed-width autorack railcar roof assembly on a variable-width autorack railcar, according to a particular embodiment. Fixed-width autorack railcar roof assembly 92 is coupled to a variable-width autorack railcar via roof rails 94. Fixed-width autorack railcar roof assembly 92 may comprise a standard width roof assembly, or any other fixed-width roof assembly.

At the center of roof assembly 92, the roof assembly and the railcar may be the same width and a vertical portion of roof rail 94 may be approximately 90 degrees. Towards the ends of roof assembly 92, the autorack railcar may be wider than roof assembly 92 and a vertical portion of roof rail 94 may slope inward towards roof assembly 92. An example roof rail is illustrated in FIGS. 10A-13C.

Figure 10A:
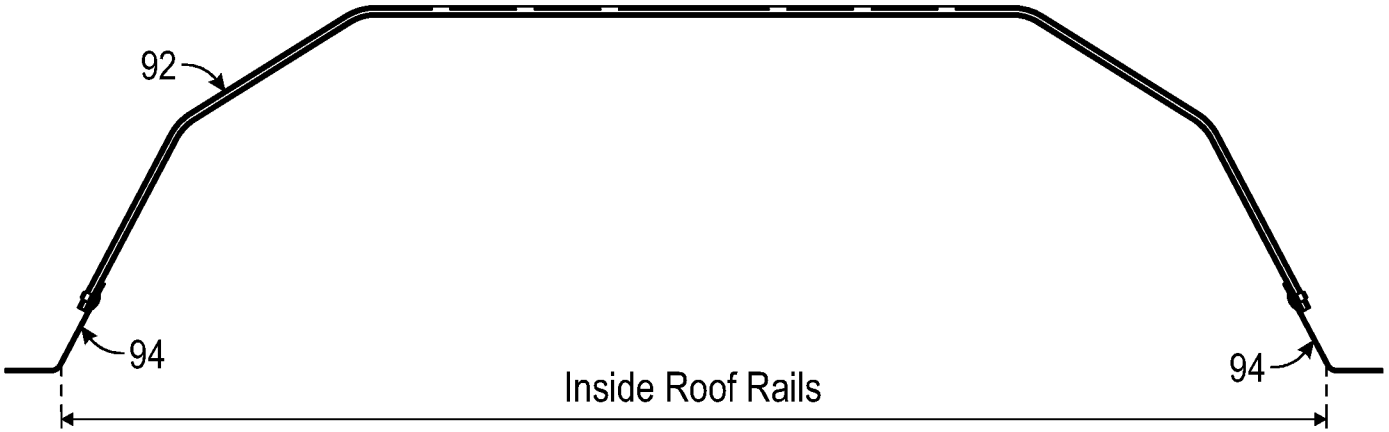
FIGS. 10A and 10B are cross sectional views of a fixed-width autorack railcar roof assembly and roof rails, according to particular embodiments.
Figure 10B:
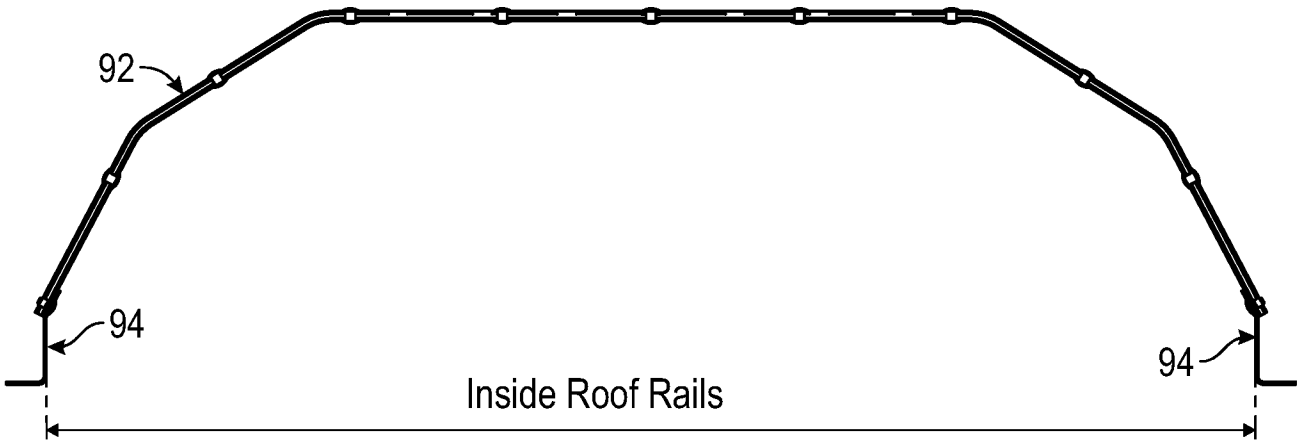

FIGS. 10A and 10B are cross sectional views of a fixed-width autorack railcar roof assembly and roof rails, according to particular embodiments. FIG. 10A illustrates roof rails 94 near the ends of roof assembly 92 where a vertical portion of roof rail 94 slopes inward towards roof assembly 92. FIG. 10B illustrates roof rails 94 near the center of roof assembly 92 where a vertical portion of roof rail 94 is approximately 90 degrees.

Figure 11:
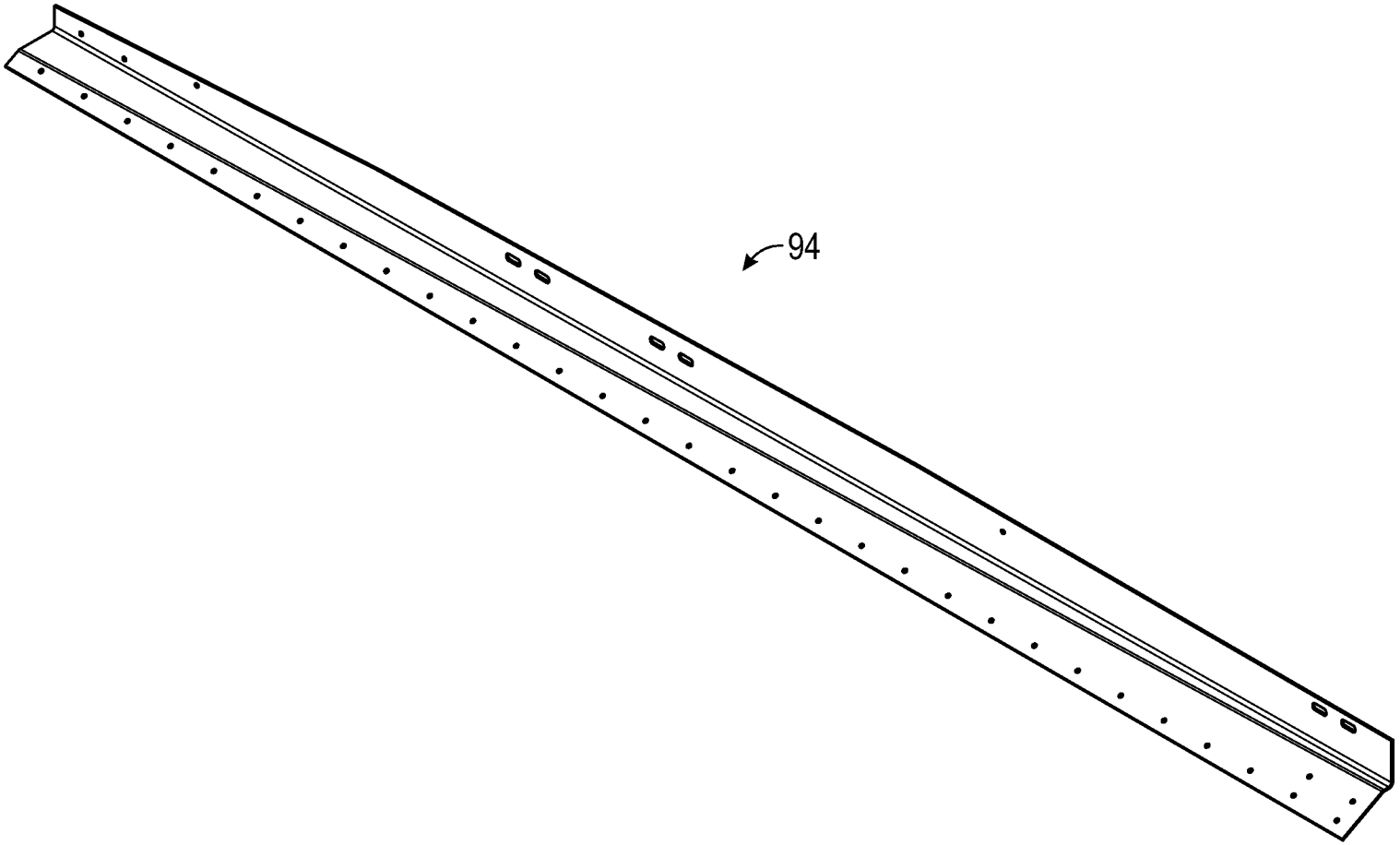
FIG. 11 is a perspective view of a roof rail, according to a particular embodiment.

FIG. 11 is a perspective view of a roof rail, according to a particular embodiment. The flanged portions of roof rail 94 taper to conform to the fixed-width autorack railcar roof assembly and the variable-width autorack railcar. A top portion of the roof rail conforms to the edge of the fixed-width autorack railcar roof assembly, and a bottom portion of the roof rail conforms to a contour of the sidewall of a variable-width autorack railcar.

Figure 12A:
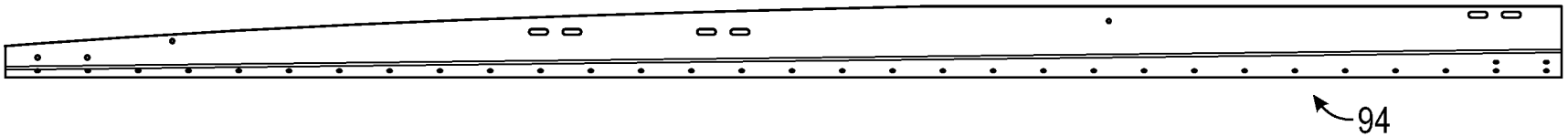
FIG. 12A is a top view of a roof rail, according to a particular embodiment.

FIG. 12A is a top view of a roof rail, according to a particular embodiment. Roof rail 94 is the same as roof rail 94 illustrated in FIG. 11.

Figure 12B:
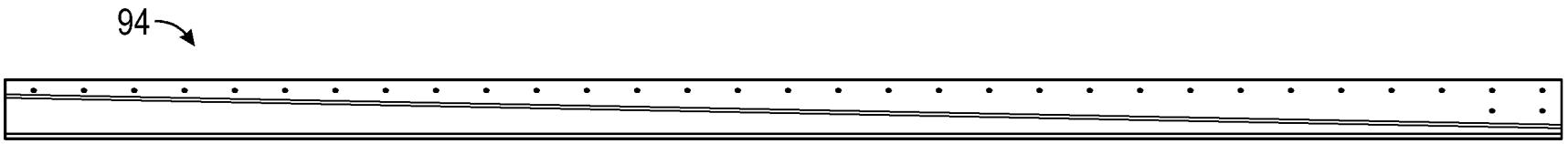
FIG. 12B is a side view of a roof rail, according to a particular embodiment.

FIG. 12B is a side view of a roof rail, according to a particular embodiment. Roof rail 94 is the same as roof rail 94 illustrated in FIG. 11.

Figure 12C:
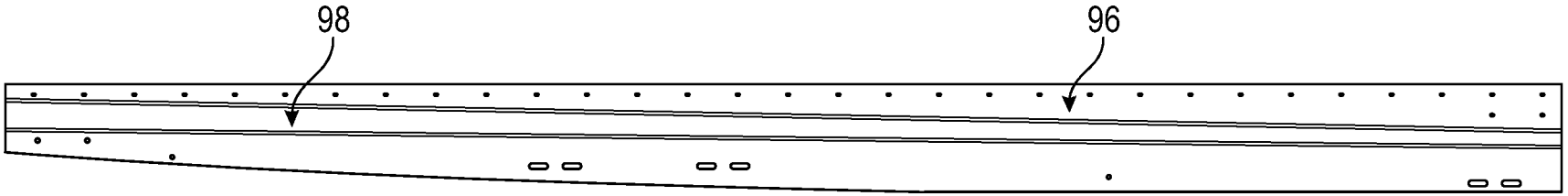
FIG. 12C is an overhead view of a flat sheet that may be formed into a roof rail, according to particular embodiments.

FIG. 12C is an overhead view of a flat sheet that may be formed into a roof rail, according to particular embodiments. For example, the flat sheet may be bent or otherwise formed along lines 96 and 98 to form roof rail 94 illustrated in FIG. 11.

Figure 13C:
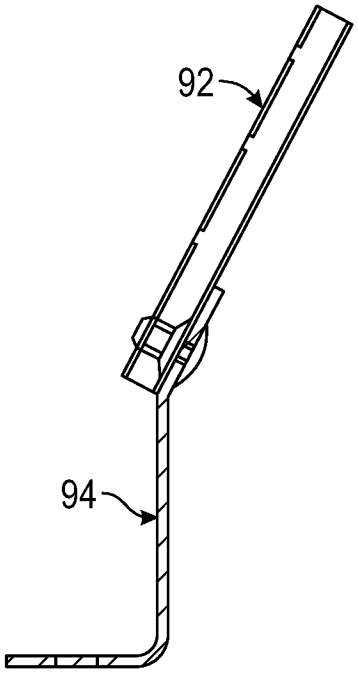
FIGS. 13A-13C are additional cross sectional views of a fixed-width autorack railcar roof assembly and roof rails, according to particular embodiments.
Figure 13B:
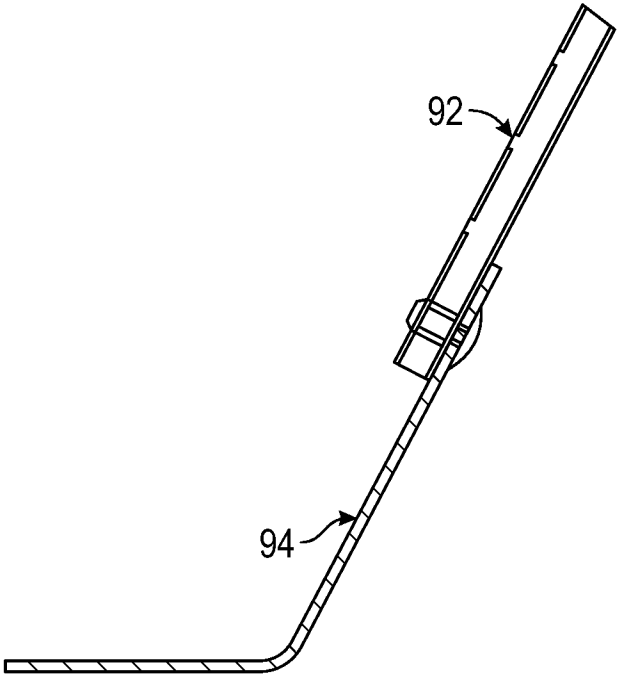
Figure 13A:
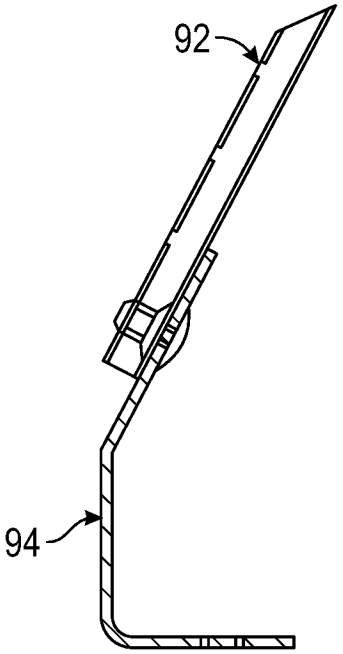

FIGS. 13A-13C are additional cross sectional views of a fixed-width autorack railcar roof assembly and roof rails, according to particular embodiments. The various angles illustrate different positions along the longitudinal length of the roof assembly.

In other embodiments, various shaped roof rails of varying length may be used to connect the roof panels to the hour glass-shaped autorack railcar.

Figure 14:
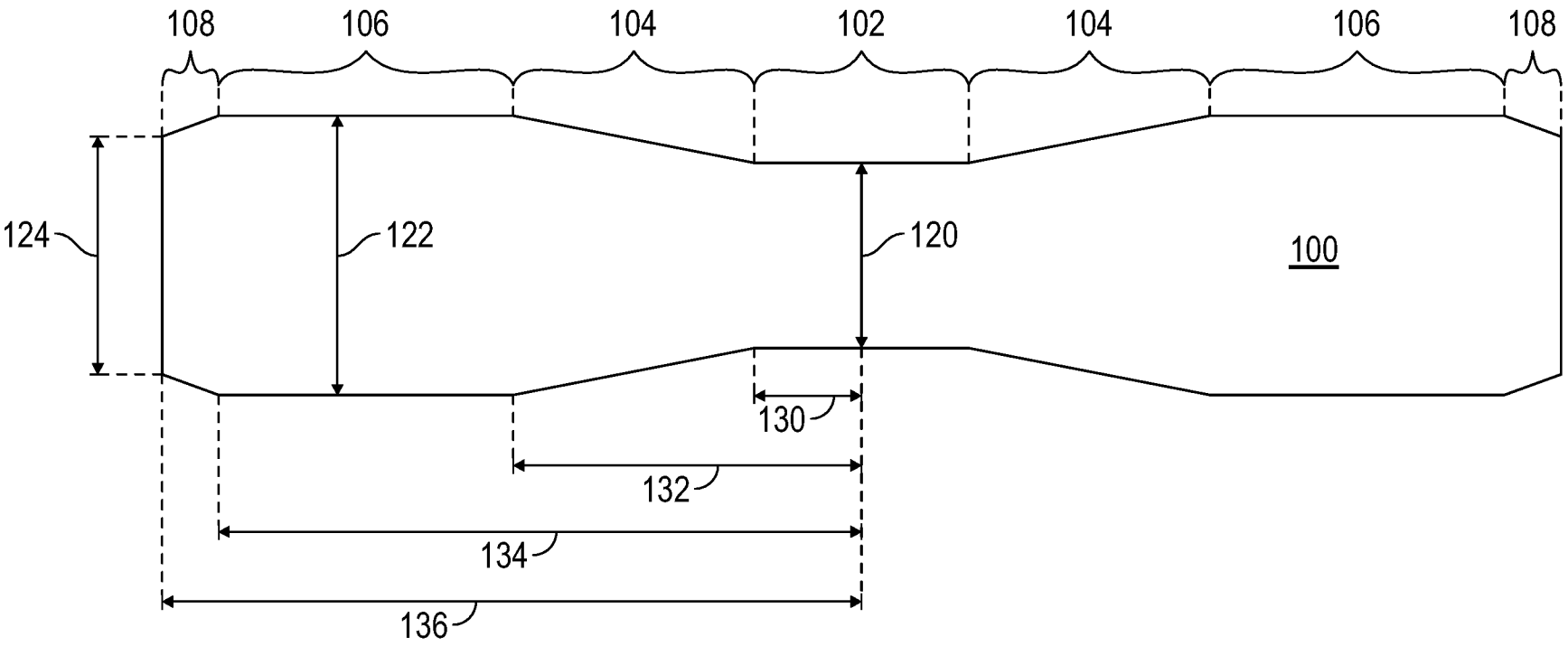
FIG. 14 is an overhead plan view of another hour glass-shaped autorack railcar roof assembly, according to a particular embodiment.

FIG. 14 is an overhead plan view of another hour glass-shaped autorack railcar roof assembly, according to a particular embodiment. Autorack railcar roof assembly 100 includes center roof panel 102, first intermediate roof panels 104, second intermediate roof panels 106 and end roof panels 108.

In the illustrated example, center roof panel 102 is a constant width. First intermediate roof panels 104 increase in width as the first intermediate roof panel extends from an edge adjacent to center roof panel 102 towards an opposite edge. Second intermediate panels 106 are a constant width. End roof panels 108 decrease in width as the end roof panel extends from an edge adjacent to second intermediate roof panel 106 towards an opposite edge. The widths of center roof panel 102, first intermediate roof panels 104, second intermediate roof panels 106, and end roof panels 108 correspond to the widths of the side walls of an underlying autorack railcar (such as the autorack railcars illustrated in FIGS. 1 and 3).

In particular embodiments, the width of autorack railcar roof assembly 100 approximates an hourglass shape with a minimum width 120 at the center of autorack railcar roof assembly 100 and a width that expands over the distance 132 to a maximum width 122. The maximum width 122 continues out to distance 134 and then reduces to end width 124 at distance 136. The additional width may provide additional room for crew members to operate and may reduce the chances of vehicle damage.

As a particular example, autorack railcar roof assembly 100 may comprise a roof assembly for a 90' railcar with trucks spaced at 66'. In this example, minimum width 120 is approximately 9'11". The width of autorack railcar roof assembly 100 may gradually increase over distance 132 to maximum width 122. In this example, maximum width 122 is approximately 10'8". The width of autorack railcar roof assembly 100 may be a constant 10'8" between distance 132 and distance 134. At the end of autorack railcar roof assembly 100, its width may gradually reduce between distance 134 and 136 (e.g., approximately 45' from center) to end width 124. In this example, end width 124 is approximately 10'3.8".

Accordingly, some portions of the example autorack railcar roof assembly 100 (e.g., the portion having width 122) may be up to approximately 9" wider than a conventional fixed width autorack railcar (i.e., 10'8"−9'11"=9"). The additional 9" may provide extra clearance (e.g., up to 4.5") on each side of a vehicle loaded in the autorack railcar, which provides additional room for a crew to perform interior operations in the autorack railcar. Other embodiments may include any suitable dimensions.

Figure 15:
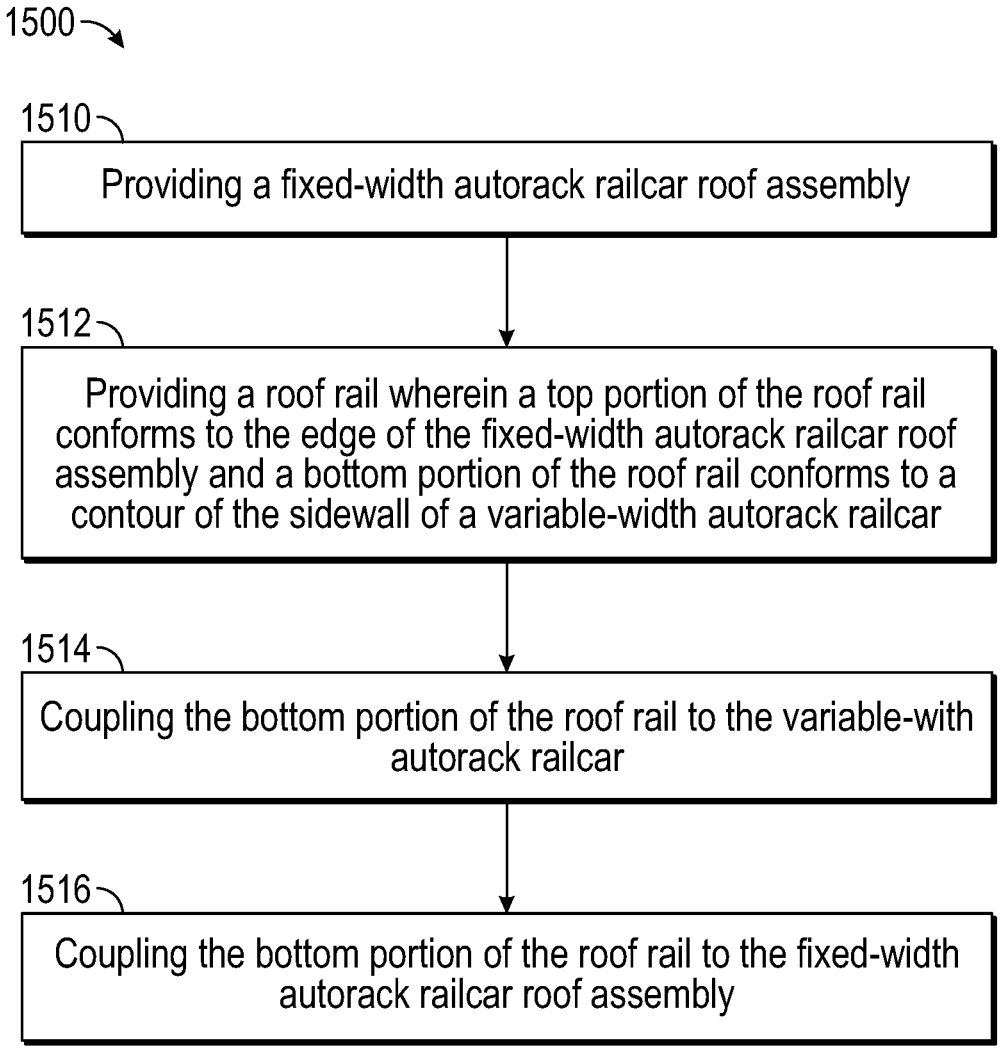
FIG. 15 is a flow diagram illustrating an example method of coupling a fixed-width autorack railcar roof assembly to a variable width autorack railcar, according to some embodiments.

FIG. 15 is a flow diagram illustrating an example method of coupling a fixed-width autorack railcar roof assembly to a variable width autorack railcar, according to some embodiments. In particular embodiments, one or more steps of method 1400 may be performed to manufacture a railcar, such as the autorack railcars described with respect to FIGS. 9-14.

The method begins at step 1510 by providing a fixed-width autorack railcar roof assembly. For example, the fixed-width autorack railcar roof assembly may comprise fixed-width autorack roof assembly 92 illustrated in FIGS. 9-10B.

At step 1512, the method comprises providing a roof rail. A top portion of the roof rail conforms to the edge of the fixed-width autorack railcar roof assembly and a bottom portion of the roof rail conforms to a contour of the sidewall of a variable-width autorack railcar For example, the roof rail may comprise the roof rail illustrated with respect to FIGS. 10A-13C.

At step 1514, the bottom portion of the roof rail is coupled (e.g., riveted, bolted, welded, etc.) to the variable-with autorack railcar.

At step 1516, the top portion of the roof rail is coupled (e.g., riveted, bolted, welded, etc.) to the fixed-width autorack railcar roof assembly.

Modifications, additions, or omissions may be made to the method of FIG. 15. Additionally, one or more steps in method 1500 of FIG. 15 may be performed in parallel or in any suitable order.

In particular embodiments, an autorack railcar may be constructed by adding a rack for transporting vehicles to a flatcar. Particular embodiments may include adding side panels, end panels or end doors, and a roof. Conventional flatcars generally have a constant width. In particular embodiments, a flatcar may be constructed with a varying width, such as any of the varying widths described in the embodiments above, for further constructing a variable width autorack railcar.

Although the example embodiments illustrated are symmetrical around a centerline of the autorack railcar, other embodiments may not be symmetrical. Particular embodiments may include articulated autorack railcars or sets of articulated autorack railcars.

Some embodiments of the disclosure may provide one or more technical advantages. As an example, some embodiments provide interior clearance that improves crew ergonomics by providing more room to conduct normal operations and reduces the likelihood of vehicle damage caused by close working conditions.

Modifications, additions, or omissions may be made to the systems and apparatuses disclosed herein without departing from the scope of the invention. The components of the systems and apparatuses may be integrated or separated. Moreover, the operations of the systems and apparatuses may be performed by more, fewer, or other components.

Modifications, additions, or omissions may be made to the methods disclosed herein without departing from the scope of the invention. The methods may include more, fewer, or other steps. Additionally, steps may be performed in any suitable order.

Although embodiments of the present disclosure and their advantages have been described in detail, it should be understood that various changes, substitutions and alternations can be made herein without departing from the spirit and scope of the invention as defined by the claims below.

The invention claimed is:

1. An autorack railcar with a variable width comprising:

a first end and a second end;

a first longitudinal side and a second longitudinal side disposed between the first end and the second end;

a roof assembly disposed longitudinally between the first end and the second end and transversely between the first longitudinal side and the second longitudinal side;

a rack for transporting vehicles generally enclosed by the first end, the second end, the first longitudinal aide, the second longitudinal side, and the roof assembly, wherein:

the roof assembly comprises a fixed-width roof and a roof rail wherein a top portion of the roof rail conforms to the edge of the fixed-width roof and a bottom portion of the roof rail comprises a variable width that conforms to a variable width contour of a sidewall of a variable-width autorack railcar;

a first width of the bottom portion of the roof rail between the first longitudinal side and the second longitudinal side proximate a center of the autorack railcar comprises a first width value; and a second width of the bottom portion of the roof rail between the first longitudinal side and the second longitudinal side between the center of the autorack railcar and either the first end or the second end comprises a second width value, the second width value greater than the first width value.

2. The autorack railcar of claim 1, wherein the first width value is approximately 9 feet 11 inches.

3. The autorack railcar of claim 1, wherein the second width value is between 9 feet 11 inches and approximately 10 feet 8 inches.

4. The autorack railcar of claim 1, wherein a third width of the bottom portion of the roof rail between the first longitudinal side and the second longitudinal side proximate either the first end or the second end comprises a third width value, the third width value greater than the first width value and greater than the second width value.

5. The autorack railcar of claim 1, wherein:

the first longitudinal side comprises a center panel and an intermediate panel, the center panel is disposed between a center of the railcar and the intermediate panel and the intermediate panel is disposed between the center panel and the first end or the second end;

a width of the railcar at the intermediate panel is greater than a width of the railcar at the center panel;

the bottom portion of the roof rail comprises a center portion and an intermediate portion, the center portion is disposed between the center panel of the first longitudinal side and the second longitudinal side, and the intermediate portion is disposed between the intermediate panel of the first longitudinal side and the second longitudinal side; and a width of the bottom portion of the roof rail at the intermediate portion is greater than a width of the bottom portion of the roof rail at the center portion.

6. The railcar of claim 5, wherein a width of the center portion is constant along the longitudinal length of the center portion.

7. The railcar of claim 5, wherein the width of the intermediate portion increases in width as the intermediate portion extends from an edge adjacent to the center portion towards the first or second end.

8. The railcar of claim 4, wherein:

the first longitudinal side further comprises an end panel disposed between the intermediate panel and the first end or the second end; and the bottom portion of the roof rail further comprises an end portion, the end portion disposed between the end panel of the first longitudinal side and the second longitudinal side.

9. The railcar of claim 8, wherein a width of the end portion is constant along the longitudinal length of the end portion.

10. The railcar of claim 5, wherein a width of the intermediate portion varies from approximately 9 feet 11 inches proximate the center portion to between 9 feet 11 inches and 10 feet 8 inches at the opposite end of the intermediate portion.

11. An autorack railcar roof assembly comprising:

a fixed-width roof and a roof rail wherein a top portion of the roof rail conforms to the edge of the fixed-width roof and a bottom portion of the roof rail comprises a variable width that conforms to a variable width contour of a sidewall of a variable-width autorack railcar;

the bottom portion of the roof rail comprising:

a center portion;

a first intermediate portion adjacent one side of the center portion;

a second intermediate portion adjacent an opposite side of the center portion from the first intermediate portion; and wherein the center portion comprises a first width and the first and second intermediate portions each comprise a second width greater than the first width.

12. The autorack railcar roof assembly of claim 11, wherein the first width value is approximately 9 feet 11 inches.

13. The autorack railcar roof assembly of claim 11, wherein the second width value is between 9 feet 11 inches and approximately 10 feet 8 inches.

14. The autorack railcar roof assembly of claim 11, wherein the width of the center portion is constant along the longitudinal length of the center portion.

15. The autorack railcar roof assembly of claim 11, wherein the width of the first and second intermediate portions increases in width as the intermediate portion extends from an edge adjacent to the center portion towards an opposite edge.

16. The autorack railcar roof assembly of claim 11, wherein a width of the first and second intermediate portion varies from approximately 9 feet 11 inches proximate the center portion to between 9 feet 11 inches and 10 feet 8 inches at an opposite edge.

17. The autorack railcar roof assembly of claim 11, further comprising:

a first end portion adjacent the first intermediate portion;

a second end portion adjacent the second intermediate portion; and wherein the first and second end portions each comprise a third width greater than the second width.

18. The autorack railcar roof assembly of claim 17, wherein a width of the first and second end portions is constant along the longitudinal length of the first and second end portions.

19. A method for coupling a fixed-width autorack railcar roof assembly to a variable width autorack railcar, the method comprising:

providing a fixed-width autorack railcar roof assembly;

providing a roof rail wherein a top portion of the roof rail conforms to the edge of the fixed-width autorack railcar roof assembly and a bottom portion of the roof rail comprises a variable width that conforms to a variable width contour of a sidewall of a variable-width autorack railcar;

coupling the bottom portion of the roof rail to the sidewall of the variable-width autorack railcar; and coupling the top portion of the roof rail to the fixed-width autorack railcar roof assembly.

20. The method of claim 19, wherein the autorack railcar comprises:

a first end and a second end;

a first longitudinal side and a second longitudinal side disposed between the first end and the second end;

a rack for transporting vehicles generally enclosed by the first end, the second end, the first longitudinal aide, and the second longitudinal side, wherein:

a first width of the autorack railcar between the first longitudinal side and the second longitudinal side proximate a center of the autorack railcar comprises a first width value; and a second width of the autorack railcar between the first longitudinal side and the second longitudinal side between the center of the autorack railcar and either the first end or the second end comprises a second width value, the second width value greater than the first width value.

* * * * *